US009017225B2

(12) United States Patent
Huang et al.

(10) Patent No.: US 9,017,225 B2
(45) Date of Patent: Apr. 28, 2015

(54) WORKOUT DEVICE WITH FOOT-ORIENTED ELLIPTICAL LOOP

(71) Applicant: Dyaco International Inc., Taipei (TW)

(72) Inventors: Hsuan-Fu Huang, Hemei Town (TW); Shih-Wei Liu, Hemei Town (TW)

(73) Assignee: Dyaco International Inc., Taipei (TW)

( * ) Notice: Subject to any disclaimer, the term of this patent is extended or adjusted under 35 U.S.C. 154(b) by 252 days.

(21) Appl. No.: 13/826,492

(22) Filed: Mar. 14, 2013

(65) Prior Publication Data

US 2014/0194256 A1 Jul. 10, 2014

(30) Foreign Application Priority Data

Jan. 7, 2013 (TW) ..... 102100460 A

(51) Int. Cl.
*A63B 21/00* (2006.01)
*A63B 22/06* (2006.01)
*A63B 23/035* (2006.01)

(52) U.S. Cl.
CPC ..... *A63B 22/0664* (2013.01); *A63B 23/03583* (2013.01)

(58) Field of Classification Search
USPC ..... 482/42, 52, 57, 51, 70, 79, 80
See application file for complete search history.

(56) References Cited

U.S. PATENT DOCUMENTS

| | | | | |
|---|---|---|---|---|
| 5,573,480 | A | 11/1996 | Rodgers, Jr. | |
| 7,682,290 | B2 | 3/2010 | Liao et al. | |
| 2006/0116247 | A1 * | 6/2006 | Dyer et al. | 482/52 |
| 2007/0219063 | A1 * | 9/2007 | Anderson et al. | 482/52 |
| 2008/0020905 | A1 * | 1/2008 | Habing | 482/52 |
| 2008/0032867 | A1 * | 2/2008 | Liao et al. | 482/52 |
| 2008/0161164 | A1 * | 7/2008 | Stewart et al. | 482/52 |
| 2010/0167880 | A1 * | 7/2010 | Long et al. | 482/52 |
| 2012/0077641 | A1 * | 3/2012 | Dyer et al. | 482/8 |

* cited by examiner

*Primary Examiner* — Jerome w Donnelly
(74) *Attorney, Agent, or Firm* — Huffman Law Group, PC

(57) ABSTRACT

A workout device with a foot-oriented elliptical loop is provided and bilaterally equipped with a transmission rod, a first link rod, a driving rod, a second link rod, a swing arm, and a supporting rod. The transmission portions are pivotally coupled to cranks to enable the cranks to undergo revolution. The supporting rods each have a supporting portion to support a user's feet. The aforesaid rods interact with each other. The supporting portions of the supporting rods move along a closed elliptical loop with segmental junctions spaced apart by a relatively short distance, such that the user's treading process is prevented from undergoing abrupt descents, unsmooth transitions, and thus jolts.

5 Claims, 9 Drawing Sheets

WORKOUT DEVICE WITH FOOT-ORIENTED ELLIPTICAL LOOP

BACKGROUND OF THE INVENTION

1. Technical Field

The present invention relates to workout devices, and more particularly, to a workout device with a foot-oriented elliptical loop.

2. Description of Related Art

Due to technological advancements and economic prosperity, people's living standards improve continuously, so does the demand for leisure and recreation, such as fitness workouts, travel, and shopping. Workouts are carried out either indoors or outdoors. Common indoor workout devices abound and include elliptical trainers, treadmills, flywheel bicycles, large weight training devices, and workout benches. The elliptical trainer guides a user's feet to follow a substantially elliptical unending path in order to take cyclic exercise. Exercising in this way not only approximates to walking or running as far as the lower limbs are concerned, but also has less impact on the user's knee joint and ankle joints. Hence, elliptical trainers are popular with consumers and thus manifest continuous market growth in recent years.

U.S. Pat. No. 5,573,480 discloses an elliptical trainer that enables a user's feet to move along a substantially elliptical path, because a supporting rod has one end for performing a circular-path motion in conjunction with a crank mechanism and has the other end whose motion is restricted to sliding along a linear path and reciprocating; hence, a specific portion of the supporting rod follows a substantially elliptical path. U.S. Pat. No. 7,682,290 disposes that one end of a supporting rod for use with a user's foot is pivotally connected to an external end of a crank to thereby restrict the supporting rod to a circular path, and discloses that the other end of the supporting rod is pivotally connected to a bottom end of a swing arm and restricted to a curved path for swinging back and forth. However, although the foot-specific supporting structure moves along an elliptical loop, the supporting structure descends abruptly as soon as the user's foot has swung to the highest level and is going to drop and return. Also, segmental junctions of the elliptical loop are so widely spaced apart that the treading process is marked by unsmooth transitions and even jolts, thereby causing discomfort to the user's knee joints and ankle joints.

BRIEF SUMMARY OF THE INVENTION

It is an objective of the present invention to provide a workout device with a foot-oriented elliptical loop whereby a user's treading process is prevented from undergoing abrupt descents, unsmooth transitions, and thus jolts.

In order to achieve the above and other objectives, the present invention provides a workout device with a foot-oriented elliptical loop, comprising a base, a crank mechanism, and two link rod mechanisms. The base is mounted on a supporting surface. The crank mechanism has two opposing cranks coupled to the base coaxially and pivotally. The link rod mechanisms are disposed on the left and right of the base, respectively, and each comprise a transmission rod, a first link rod, a driving rod, a second link rod, a swing arm, and a supporting rod. The transmission rod has a first transmission portion and a second transmission portion. The transmission portion is pivotally coupled to the cranks to enable the cranks to move upward, downward, forward, and backward and thereby undergo revolution relative to the base. The first link rod has first and second end portions. The first end portion is pivotally coupled to the first transmission portion. The driving rod has a first driving portion and a second driving portion. The first driving portion is pivotally coupled to the second end portion. The second link rod has a first pivotally rotating portion, a second pivotally rotating portion, and a transit portion. The first pivotally rotating portion is pivotally coupled to the second driving portion. The transit portion is pivotally coupled to the base. The swing arm has a pivotally connecting portion and a swinging portion. The pivotally connecting portion is pivotally coupled to the second pivotally rotating portion. The supporting rod has a first connection portion, a second connection portion, and a supporting portion. The first connection portion is pivotally coupled to the second transmission portion. The second connection portion is pivotally coupled to the swinging portion. The supporting portion supports the user's feet.

Accordingly, the present invention provides a workout device with a foot-oriented elliptical loop whose segmental junctions are spaced apart by a distance short enough to prevent the supporting structure from descending abruptly as soon as the user's foot has swung to the highest level and is going to drop and return, and free the treading process from unsmooth transitions and thus jolts.

To enable examiners to gain insight into the structure, features, and objectives of the present invention, the present invention is hereunder illustrated with several embodiments and the accompanying drawings, so that persons skilled in the art can implement the present invention accordingly. However, the embodiments described hereunder are illustrative rather than restrictive of the present invention. Hence, a wide variety of simple modifications, replacements, and components omissions made by persons skilled in the art to the embodiments of the present invention without departing from the spirit embodied therein shall fall into the scope of protection intended to be provided by the present invention.

DETAILED DESCRIPTION OF THE INVENTION

Figure 1:
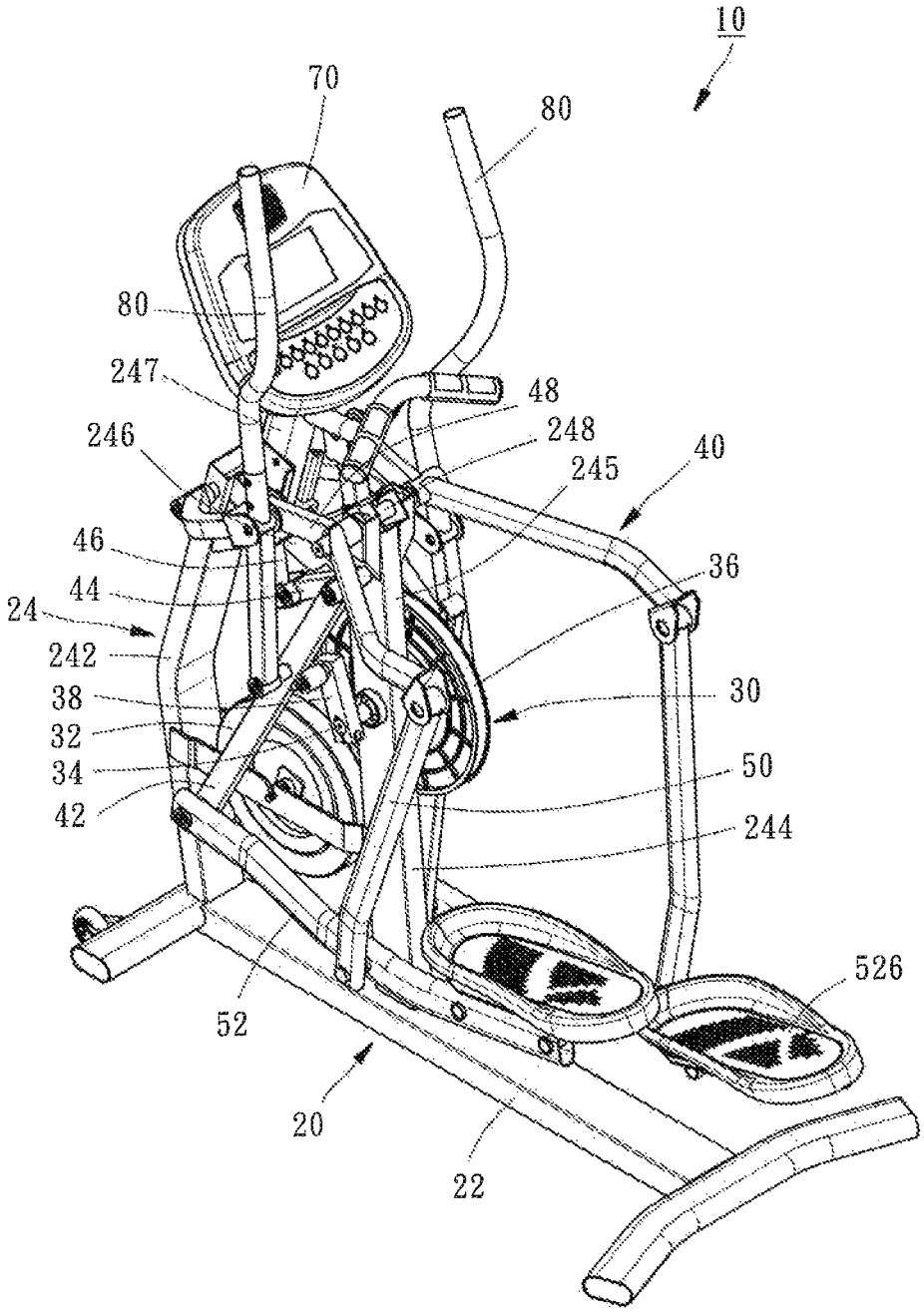
FIG. 1 is a left rear perspective view of a workout device according to a preferred embodiment of the present invention.
Figure 2:
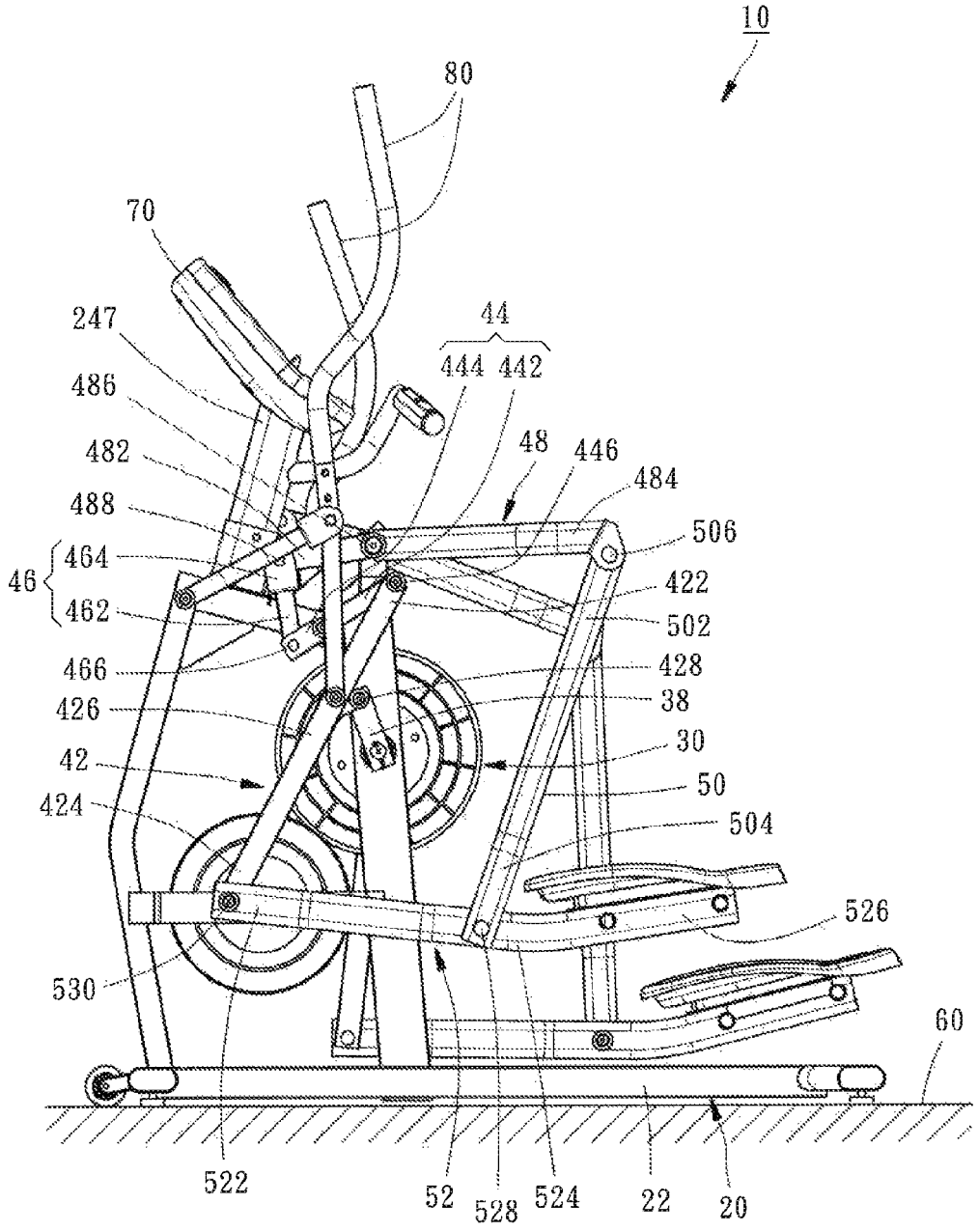
FIG. 2 is a left lateral view of the workout device according to the preferred embodiment of the present invention.
Figure 3:
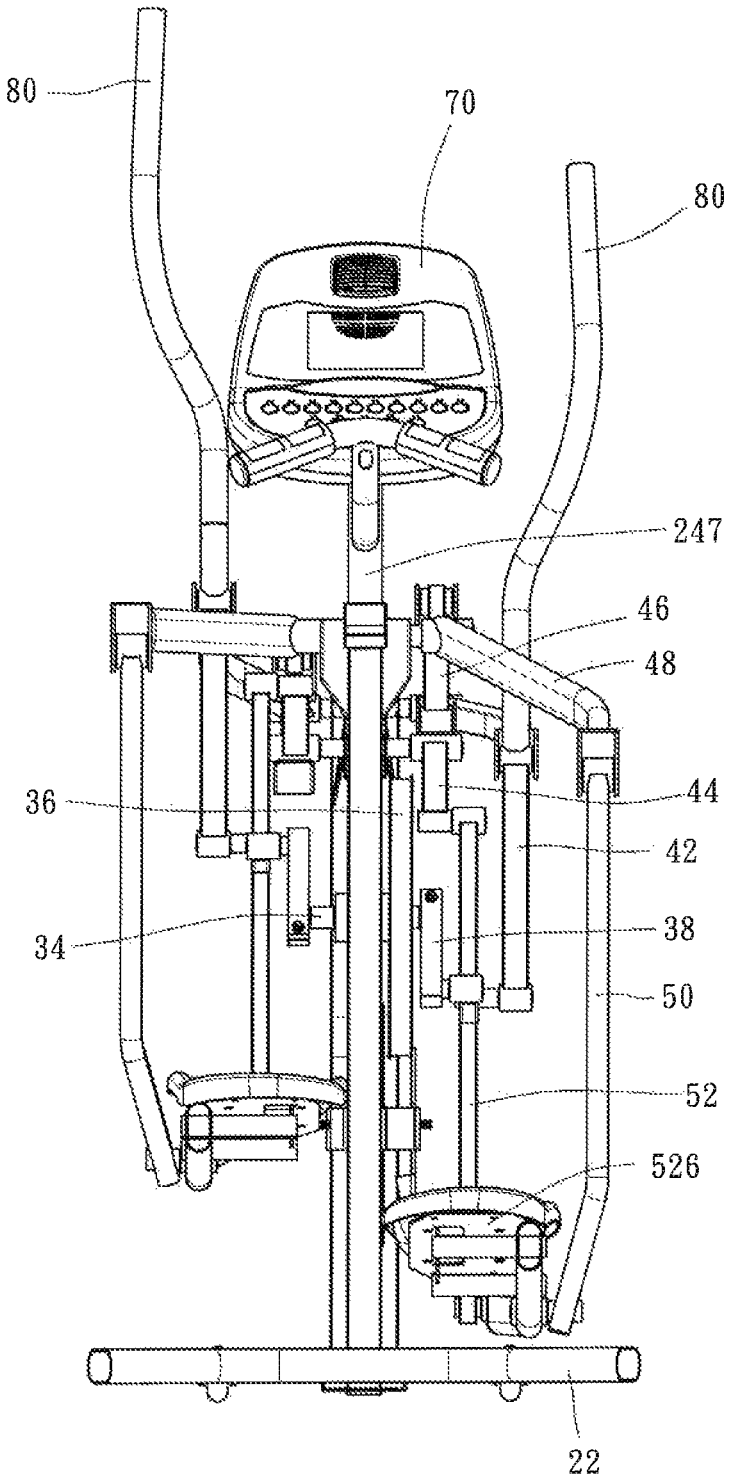
FIG. 3 is a rear view of the workout device according to the preferred embodiment of the present invention.
Figure 4:
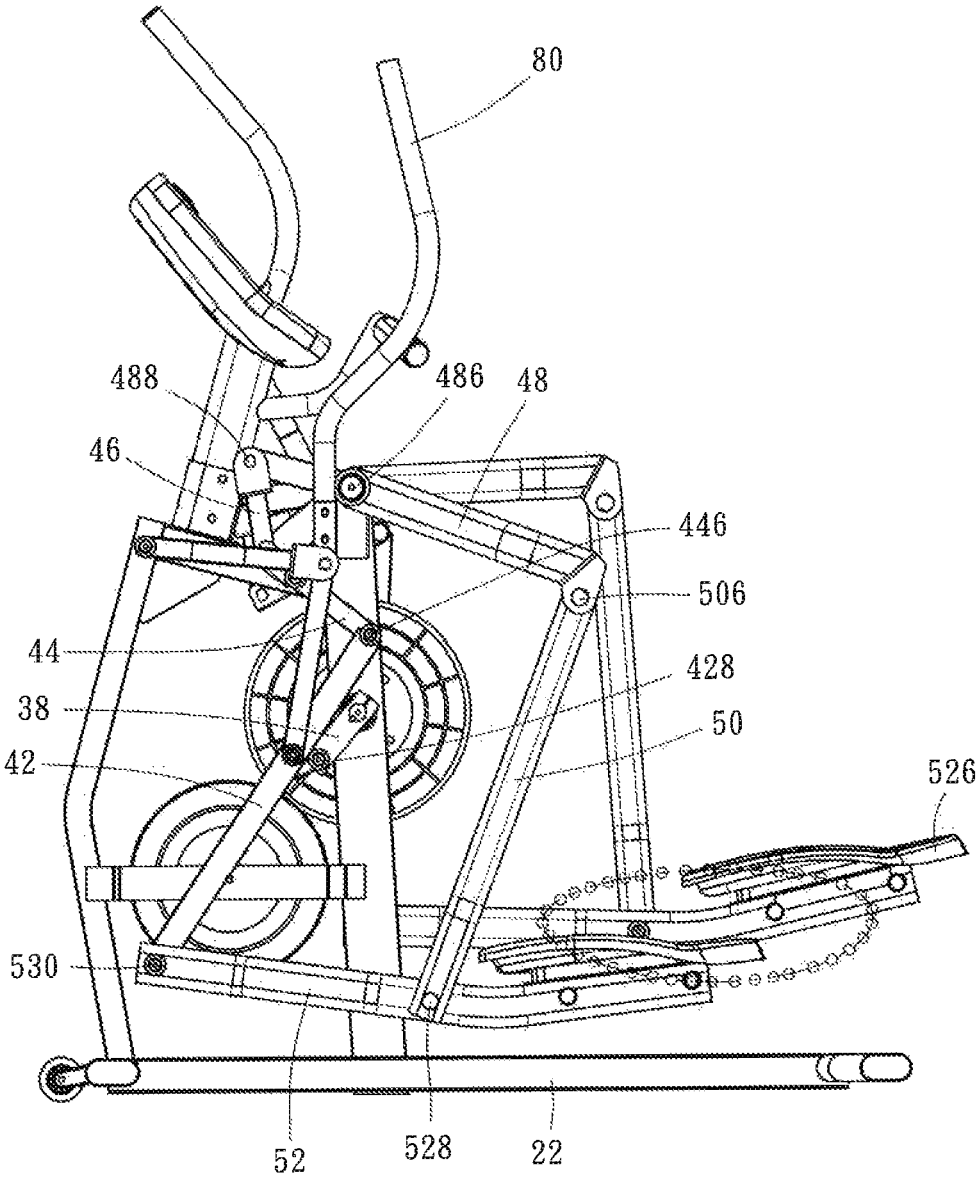
FIG. 4 is a left lateral view of the workout device according to the preferred embodiment of the present invention, depicting a foot-oriented elliptical loop.
Figure 5:
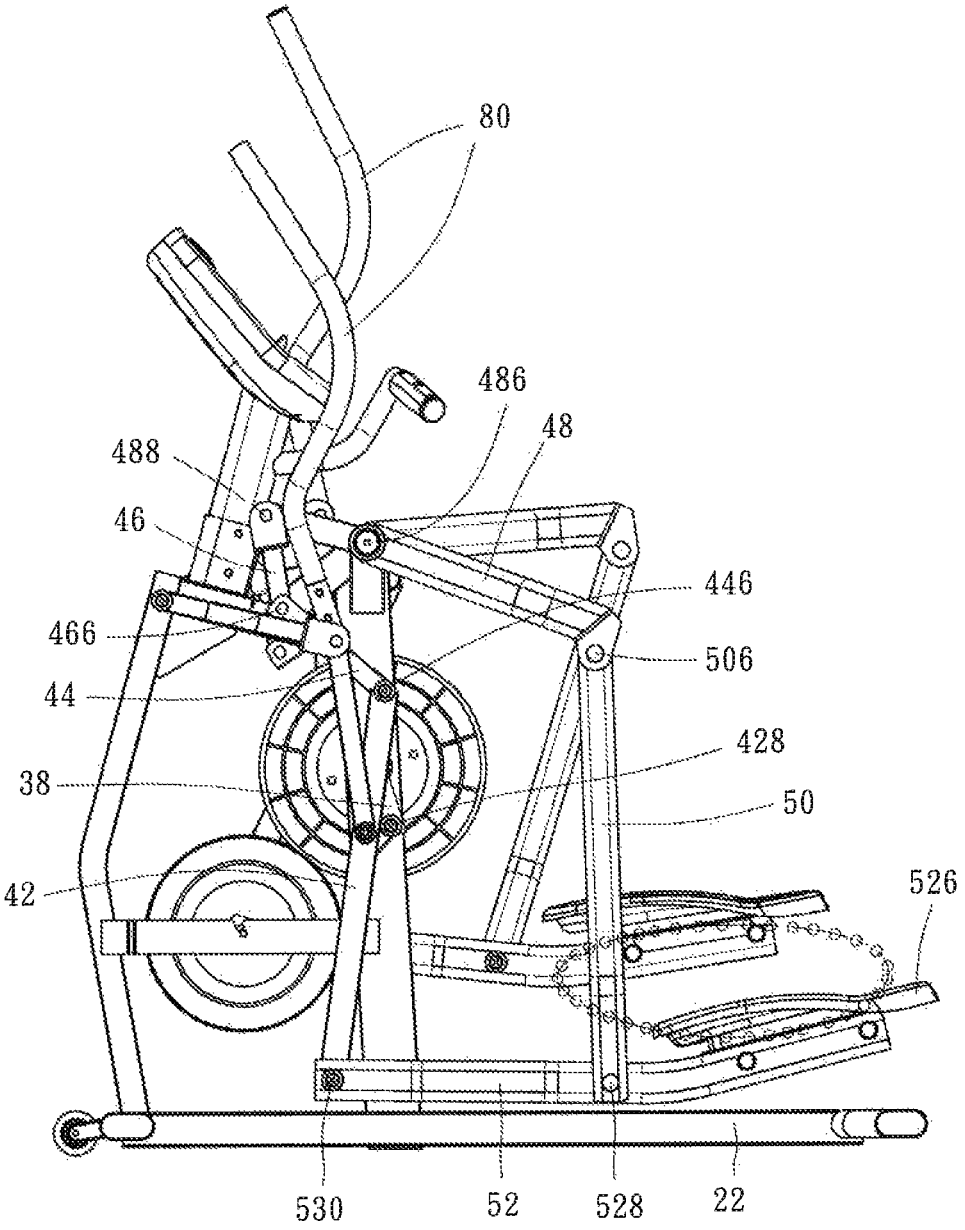
FIG. 5 through FIG. 9 are similar to FIG. 4, depicting a user's treading path.
Figure 6:
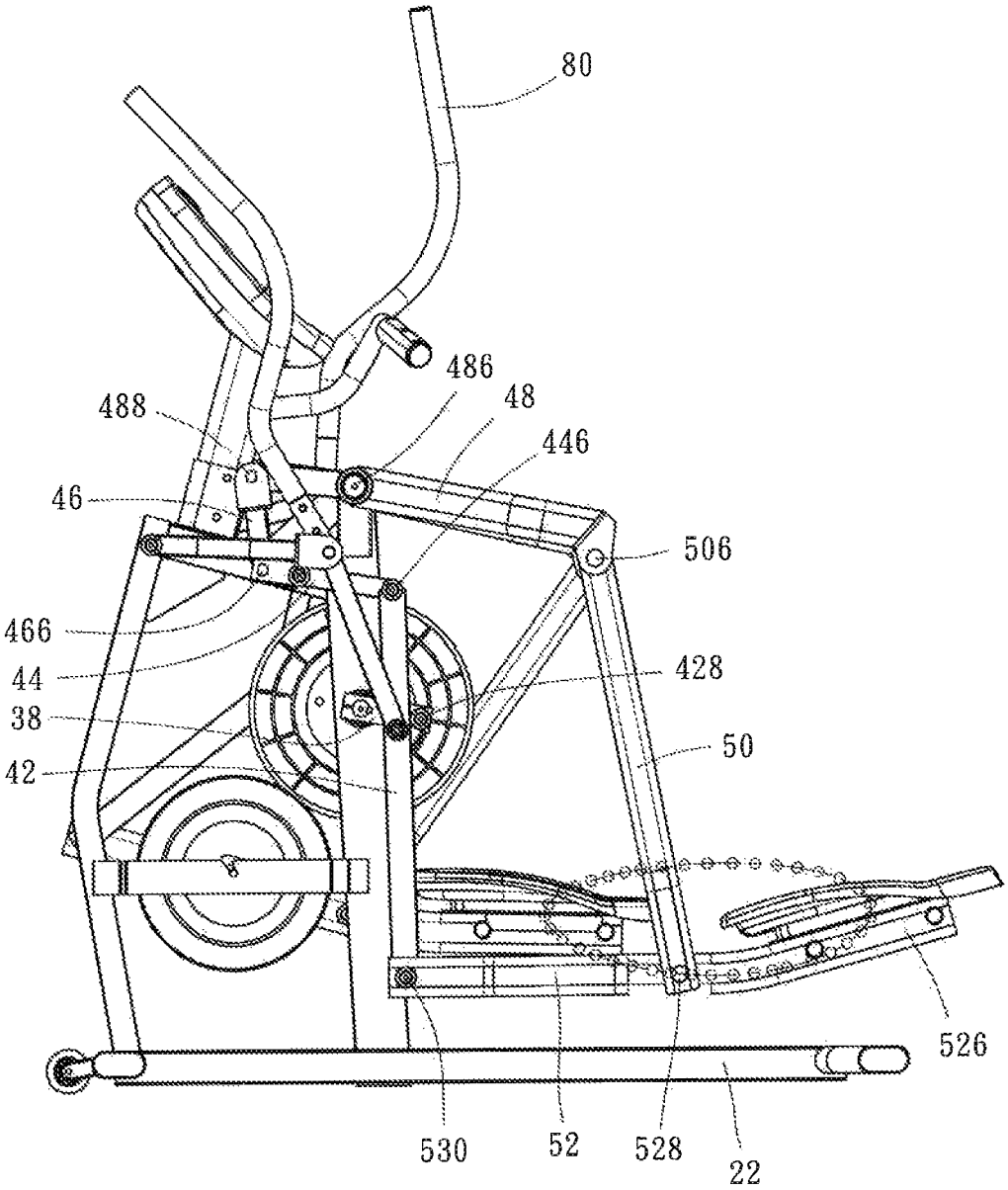
Figure 7:
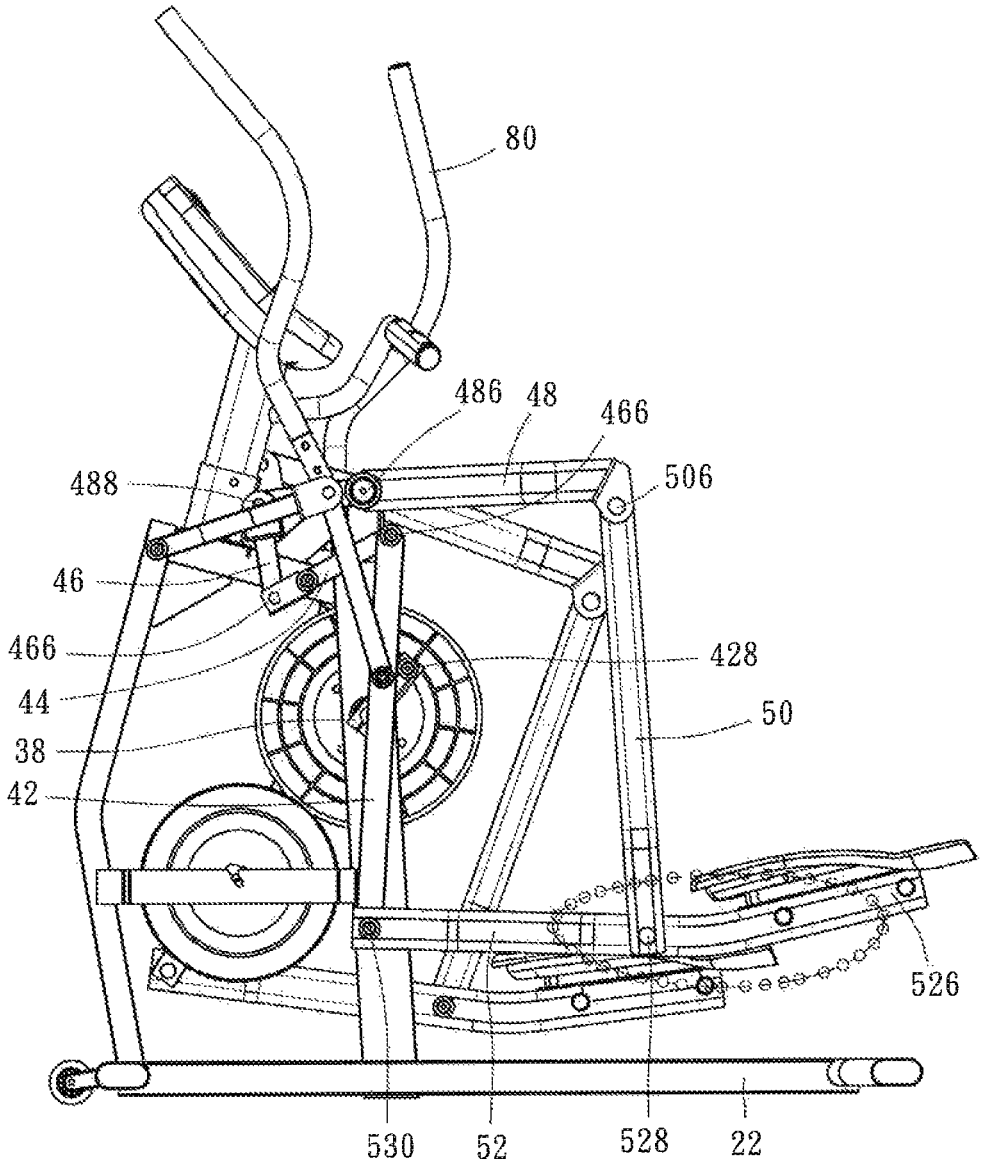
Figure 8:
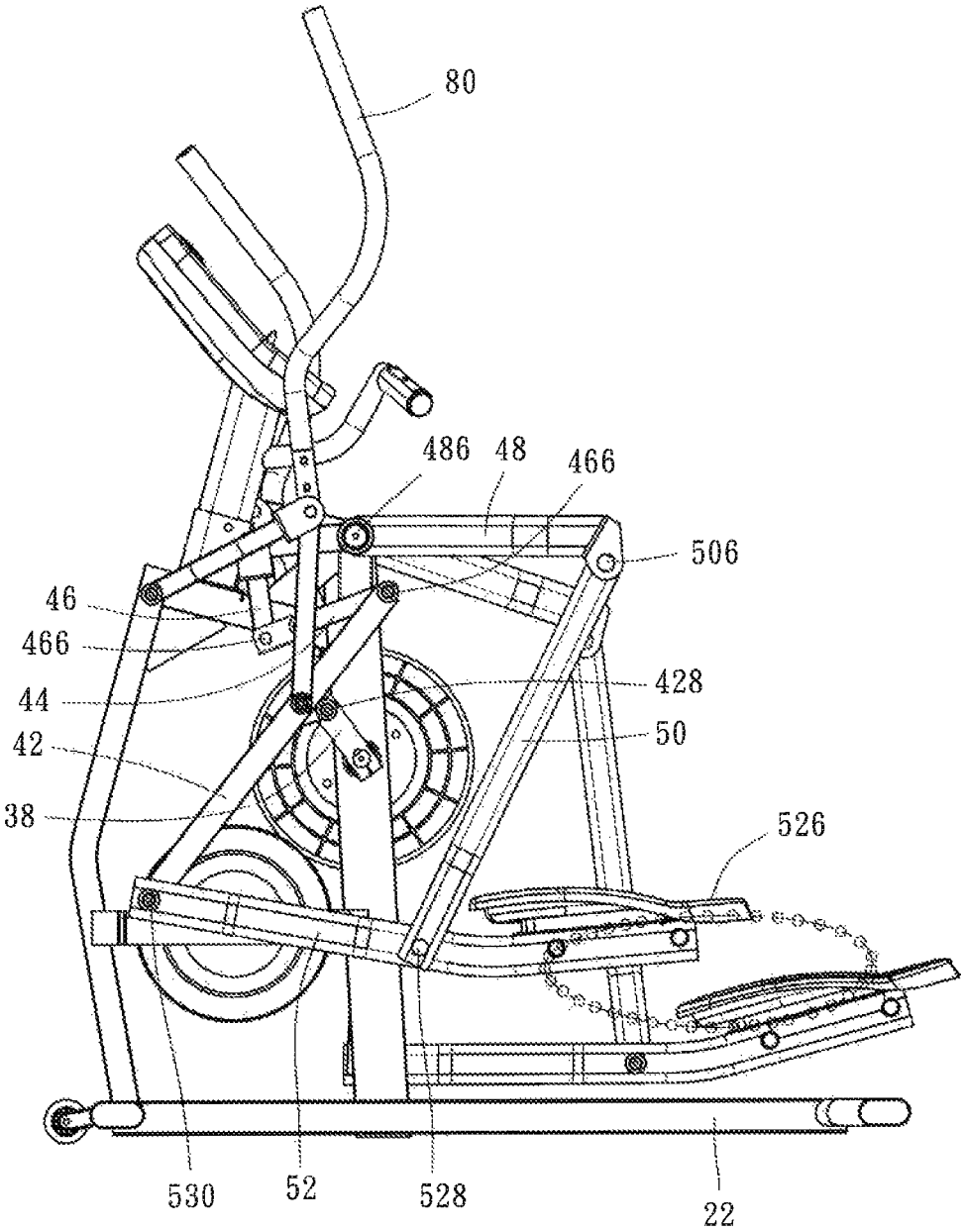
Figure 9:
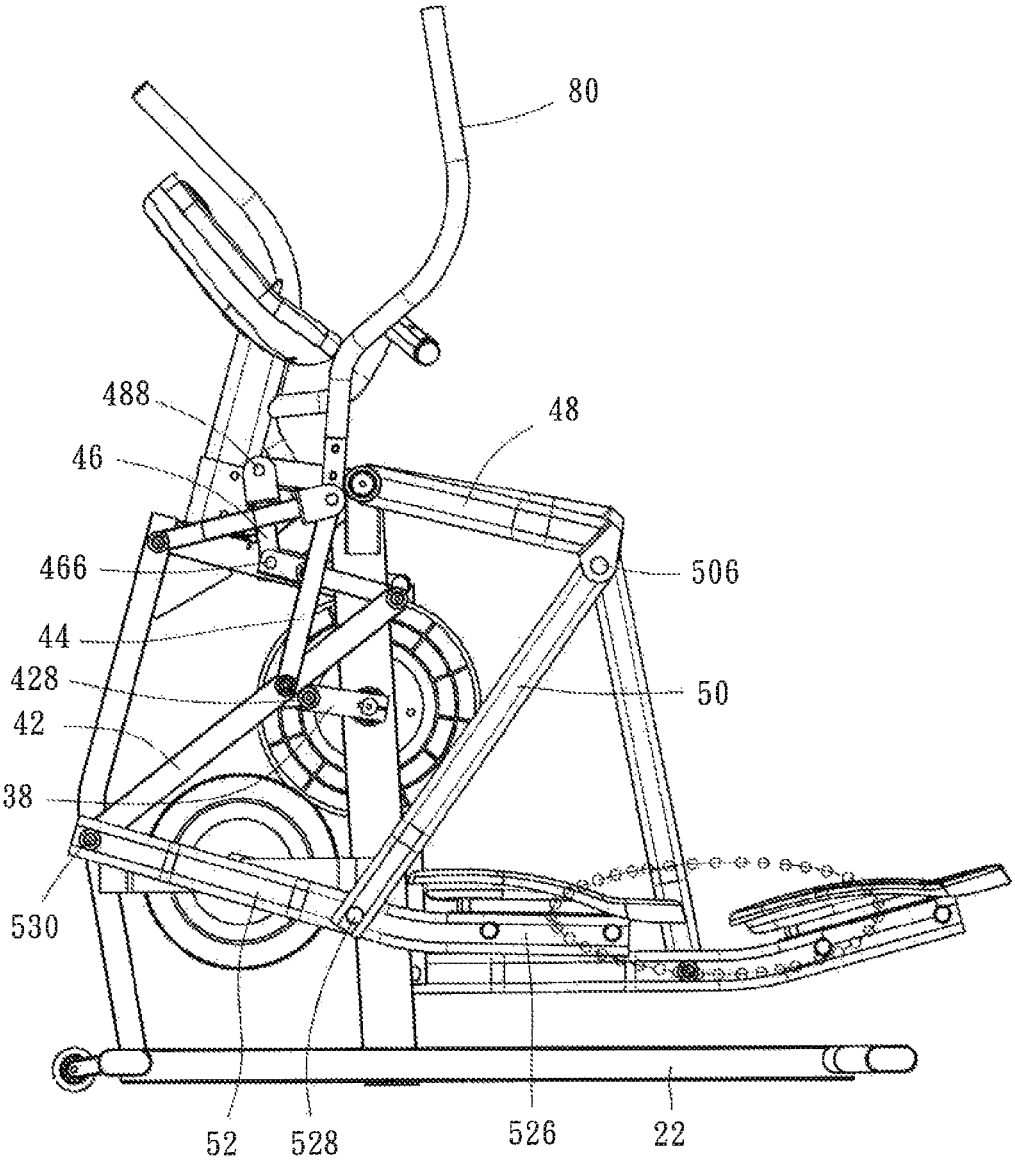

Technical contents and features of the present invention are hereunder illustrated with specific embodiments in conjunction with the accompanying drawings, in which:

FIG. 1 is a left rear perspective view of a workout device according to a preferred embodiment of the present invention;

FIG. 2 is a left lateral view of the workout device according to the preferred embodiment of the present invention;

FIG. 3 is a rear view of the workout device according to the preferred embodiment of the present invention;

FIG. 4 is a left lateral view of the workout device according to the preferred embodiment of the present invention, depicting a foot-oriented elliptical loop; and FIG. 5 through FIG. 9 are similar to FIG. 4, depicting a user's treading path.

Referring to FIG. 1 through FIG. 3, there are shown diagrams of a workout device 10 with a foot-oriented elliptical loop according to a preferred embodiment of the present invention, comprising a base 20, a crank mechanism 30, two link rod mechanisms 40, and a control panel 70.

The base 20 is mounted on a supporting surface 60 and adapted to underpin the other components. The base 20 has a bottom 22 that lies flat on the supporting surface 60. An upright frame 24 is fixedly disposed at the front end of the bottom 22. The frame 24 has a front end at which a first vertical section 242 is positioned, and a rear end at which a second vertical section 244 is positioned. A horizontal section 246 is disposed between the first and second vertical sections 242, 244. The second vertical section 244 extends in the direction of the horizontal section 246 to form an extending section 245. A transverse rod 248 is disposed at the top end of the extending section 245. A fixing rod 247 protruding outward is disposed above the horizontal section 246. A control panel 70 is disposed at the top end of the fixing rod 247.

The crank mechanism 30 comprises a flywheel 32, a crankshaft 34, a first belt pulley 36, and two cranks 38. The flywheel 32 is disposed between the first vertical section 242 and the second vertical section 244 of the frame 24. A second belt pulley (not shown) is fixed to the flywheel 32 laterally and coaxially. The crankshaft 34 is pivotally coupled to the second vertical section 244 of the frame 24. The first belt pulley 36 is fixed to the crankshaft 34 coaxially. The cranks 38 are vertically fixed to the crankshaft 34 from both sides thereof. A transmission belt (not shown) is disposed around the first belt pulley 36 and the second belt pulley and there between to thereby enable the belt pulleys 36 to rotate in opposite directions and enable the crank mechanism 30 to rotate by inertia through the flywheel 32.

The link rod mechanisms 40 flank the base 20 by being positioned on the left and right thereof, respectively. The link rod mechanisms 40 each comprise a transmission rod 42, a first link rod 44, a driving rod 46, a second link rod 48, a swing arm 50, and a supporting rod 52. The transmission rod 42 has a first transmission portion 422, a second transmission portion 424, and a third transmission portion 426. The third transmission portion 426 is disposed between the first transmission portion 422 and the second transmission portion 424. The cranks 38 are pivotally coupled to the third transmission portions 426, respectively, and each form a first pivotal point 428 whereby the cranks 38 move upward, downward, forward, and backward to thereby undergo revolution relative to the base 20. The first link rod 44 has first and second end portions 442, 444. The first end portion 442 is pivotally coupled to the first transmission portion 422 and forms a second pivotal point 446. The driving rod 46 has a first driving portion 462 and a second driving portion 464. The first driving portion 462 is pivotally coupled to the second end portion 444 and forms a third pivotal point 466. The second link rod 48 has a first pivotally rotating portion 482, a second pivotally rotating portion 484, and a transit portion 486. The first pivotally rotating portion 482 is pivotally coupled to the second driving portion 464 to forms a fourth pivotal point 488. The transit portion 486 is pivotally coupled to the transverse rod 248 of the extending section 245 of the base 20 to thereby enable the second link rod 48 to function as a lever. The swing arm is positioned behind the transmission rod 42 and has a pivotally connecting portion 502 and a swinging portion 504. The pivotally connecting portion 502 is pivotally coupled to the second pivotally rotating portion 484 to form a fifth pivotal point 506. The supporting rod 52 extends both forward and backward and has a first connection portion 522, a second connection portion 524, and a supporting portion 526. The first connection portion 522 is disposed at the front end of the supporting rod 52. The supporting portion 526 is disposed at the rear end of the supporting rod 52. The second connection portion 524 is disposed between the first connection portion 522 and the supporting portion 526. The second connection portion 524 is pivotally coupled to the swinging portion 504 to form a sixth pivotal point 528. The first connection portion 522 is pivotally coupled to the second transmission portion 424 to form a seventh pivotal point 530. The supporting portion 526 supports the user's feet. Handlebars 80, which the user holds on to, are pivotally coupled between the first transmission portion 422 and the second transmission portion 424 of the transmission rod 42. The handlebars 80 extend upward from the second link rods 48, respectively, and are capable of swinging forward and backward.

Referring to FIG. 4 through FIG. 9, due to the revolution of the cranks 38, the displacement of the transmission rods 42, the driving rods 46, and the first and second link rods 44, 48, as well as the swing of the swing arms 50 and the supporting rods 52, which act interactively, the supporting portions 526 of the supporting rods 52 are each located at a corresponding position on the elliptical loop as soon as the cranks 38 revolve by an angle, whereas the supporting portions 526 of the supporting rods 52 are each located at an opposite position on the elliptical loop as soon as the cranks 38 revolve backward. Furthermore, the first pivotal points 428 manifest closed loop movement of revolution. The second, third and fifth pivotal points 446, 466, 506 manifest closed loop movement of upward and downward displacement. The fourth pivotal points 488 manifest closed loop movement of an inclination angle. The seventh pivotal Points 530 manifest closed loop movement of forward and backward displacement. The sixth pivotal points 528 manifest path-specific movement of upward, downward, forward, and backward curved displacement. In this regard, the supporting portions 526 of the supporting rods 52 move along a closed elliptical loop with segmental junctions spaced apart by a relatively short distance. Hence, during a workout session in which the user takes exercise with the workout device of the present invention, with the segmental junctions being spaced apart by a relatively short distance, even when the supporting portion 526 reaches the highest level and is going to descend and revolve, the supporting portion 526 does not descend abruptly, nor is the treading process marked by unsmooth transitions and even jolts.

In conclusion, each of the link rod mechanisms 40 of the workout device 10 with a foot-oriented elliptical loop has a transmission rod 42, a first link rod 44, a driving rod 46, a second link rod 48, a swing arm 50, and a supporting rod 52 which operate interactively, wherein the supporting portions 526 of the supporting rods 52 move along a closed elliptical loop with segmental junctions spaced apart by a relatively short distance, such that the user's treading process is prevented from undergoing abrupt descents, unsmooth transitions, and thus jolts.

The components disclosed in the above embodiments of the present invention are illustrative rather than restrictive of the present invention. Therefore, their replacement with other equivalent components and changes made to the above embodiments of the present invention shall fall into the scope of the claims of the present invention.

What is claimed is:

1. A workout device with a foot-oriented elliptical loop, comprising:

a base mounted on a supporting surface;

a crank mechanism having two opposing cranks coupled to the base coaxially and pivotally; and two link rod mechanisms disposed on the left and right of the base, respectively, and each comprising a transmission rod, a first link rod, a driving rod, a second link rod, a swing arm, and a supporting rod, the transmission rod having a first transmission portion and a second transmission portion, the first and second transmission portions being pivotally coupled to the cranks to enable the cranks to move upward, downward, forward, and backward and thereby undergo revolution relative to the base, the first link rod having first and second end portions, the first end portion being pivotally coupled to the first transmission portion, the driving rod having a first driving portion and a second driving portion, the first driving portion being pivotally coupled to the second end portion, the second link rod having a first pivotally rotating portion, a second pivotally rotating portion, and a transit portion, the first pivotally rotating portion being pivotally coupled to the second driving portion, the transit portion being pivotally coupled to the base, the swing arm having a pivotally connecting portion and a swinging portion, the pivotally connecting portion being pivotally coupled to the second pivotally rotating portion, the supporting rod having a first connection portion, a second connection portion, and a supporting portion, the first connection portion being pivotally coupled to the second transmission portion, the second connection portion being pivotally coupled to the swinging portion, and the supporting portion supporting a user's feet.

2. The workout device with a foot-oriented elliptical loop of claim 1, wherein the cranks are each pivotally coupled between the first transmission portion and the second transmission portion of the transmission rod.

3. The workout device with a foot-oriented elliptical loop of claim 1, wherein the swing arms are disposed behind the transmission rods, respectively, the supporting portions extending forward and backwards, the first connection portion being disposed at a front end of the supporting rod, the supporting portion being disposed at a rear end of the supporting rod, and the second connection portion being disposed between the first connection portion and the supporting portion.

4. The workout device with a foot-oriented elliptical loop of claim 1, wherein a handlebar extending upward from each of the second link rods and capable of swinging forward and backward is pivotally coupled between the first transmission portion and the second transmission portion of the transmission rod.

5. The workout device with a foot-oriented elliptical loop of claim 1, wherein a third transmission portion is disposed between the first transmission portion and the second transmission portion of the transmission rod, and the cranks are pivotally coupled to the third transmission portions, respectively.

* * * * *